US006381999B1

(12) United States Patent
Doong

(10) Patent No.: US 6,381,999 B1
(45) Date of Patent: May 7, 2002

(54) POWER SUPPLYING DEVICE FOR A DOOR LOCK

(76) Inventor: Shing-Hwa Doong, 4 Fl., No. 6, Lane 6, Sec. 1, Hangchow S. Rd., Taipei (TW)

( * ) Notice: Subject to any disclaimer, the term of this patent is extended or adjusted under 35 U.S.C. 154(b) by 0 days.

(21) Appl. No.: 09/753,637

(22) Filed: Jan. 2, 2001

(51) Int. Cl.[7] ..... E05B 49/00; E05B 59/00

(52) U.S. Cl. ..... 70/107; 70/277; 70/280; 70/282; 292/144

(58) Field of Search ..... 70/107, 277, 278.1, 70/278.6, 278.7, 281, 280, 282; 292/144

(56) References Cited

U.S. PATENT DOCUMENTS 3,751,086 A * 8/1973 Geringer ..... 292/144
3,966,289 A * 6/1976 Schlage ..... 292/144 X
3,967,478 A * 7/1976 Guinn ..... 70/144
4,904,005 A * 2/1990 Frolov ..... 292/144 X
4,946,207 A * 8/1990 Gillham ..... 292/144 X
5,377,513 A * 1/1995 Miyamoto et al. ..... 70/277 X
5,490,698 A * 2/1996 Dezso ..... 292/138
5,729,198 A * 3/1998 Gorman ..... 70/279.1 X
5,943,888 A * 8/1999 Lawson ..... 70/278.7
6,035,676 A * 3/2000 Hudspeth ..... 70/278.1
6,046,681 A * 4/2000 Solop ..... 70/280 X
6,076,385 A * 6/2000 Pedroso et al. ..... 70/257
6,318,138 B1 * 11/2001 Mathews et al. ..... 70/278.7

* cited by examiner

*Primary Examiner*—Lloyd A. Gall
(74) *Attorney, Agent, or Firm*—Dellett and Walters

(57) ABSTRACT

A power supplying device for a door lock has a body, a dead bolt and a latch bolt installed on the body. A tongue is formed at a distal end of a latch bolt. A resilient member is provided between a disk and a flange on the latch bolt. An iron core is movably installed on the body and has a first coil connected with a circuit board by a first wire. The iron core is electrically connected with the storage battery. An inductor formed inside a strike plate has a coil for receiving the iron core. The coil is electrically connected with a transformer by a wire, and the transformer is supplied with AC. Whereby, an induced current is generated in the coil by the mutual inductance between the iron core and the inductor to charge the storage battery for supplying power to the motor.

13 Claims, 5 Drawing Sheets

POWER SUPPLYING DEVICE FOR A DOOR LOCK

BACKGROUND OF THE INVENTION

1. Field of the Invention

The present invention is related to a door lock, and more particularly to a power supply device for a door lock which can be locked and unlocked by a motor.

2. Description of Related Art

A door lock which is able to be locked and unlocked by an electric motor must be supplied with power by wires. However, the wires provided on a door have a great chance of being pinched and thus damaged between the door and the doorframe, when a user opens or closes the door.

Therefore, the invention provides a power supplying device to mitigate and/or obviate the aforementioned problem.

SUMMARY OF THE INVENTION

The main objective of the present invention is to provide a power supplying device, of which wires won't be pinched and damaged between a door and the doorframe.

Other objects, advantages and novel features of the invention will become more apparent from the following detailed description when taken in conjunction with the accompanying drawings.

DETAILED DESCRIPTION OF THE PREFERRED EMBODIMENT

Figure 1:
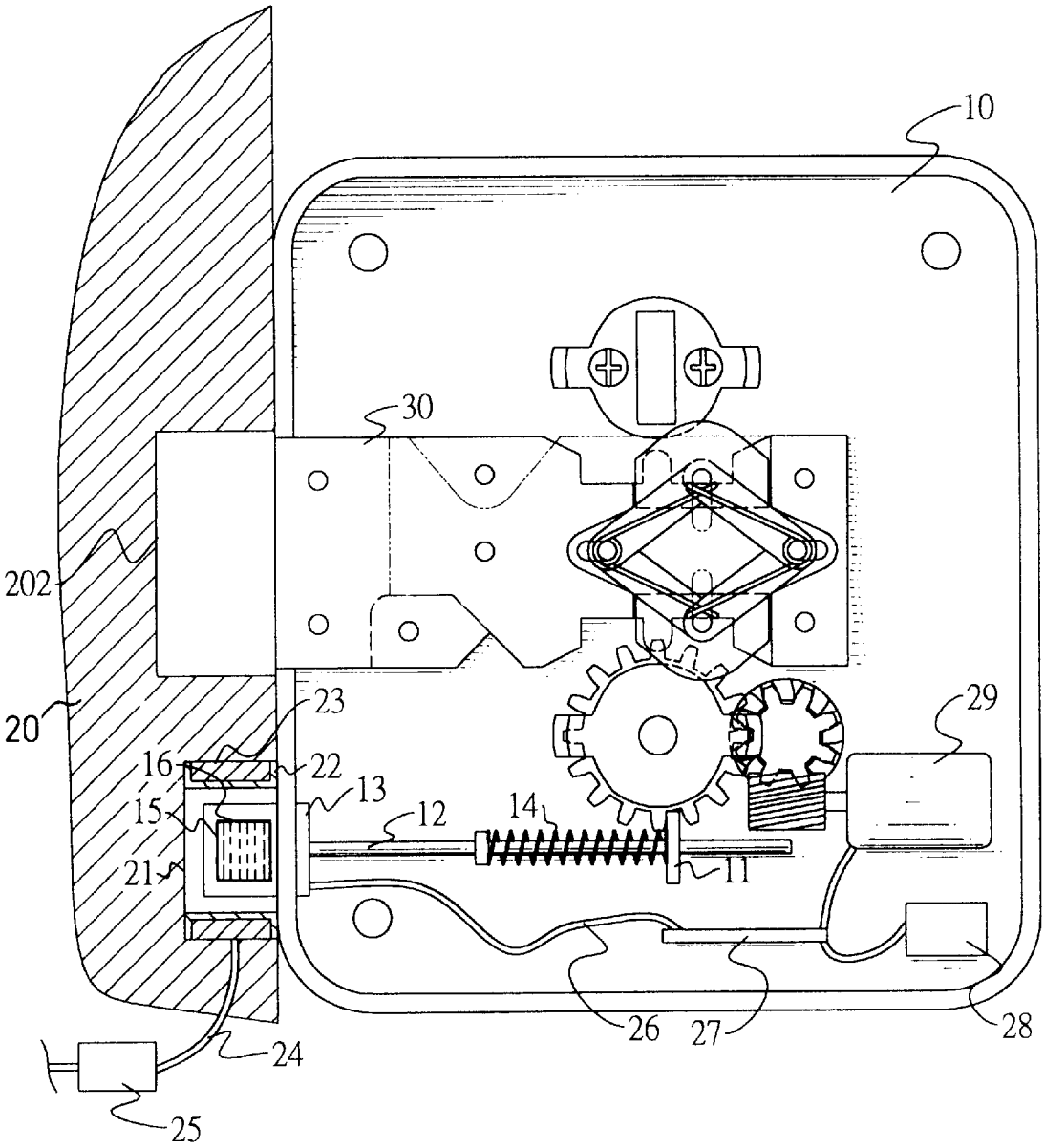
FIG. 1 is a schematic view of a first embodiment of a power supplying device in accordance with the invention.
Figure 2:
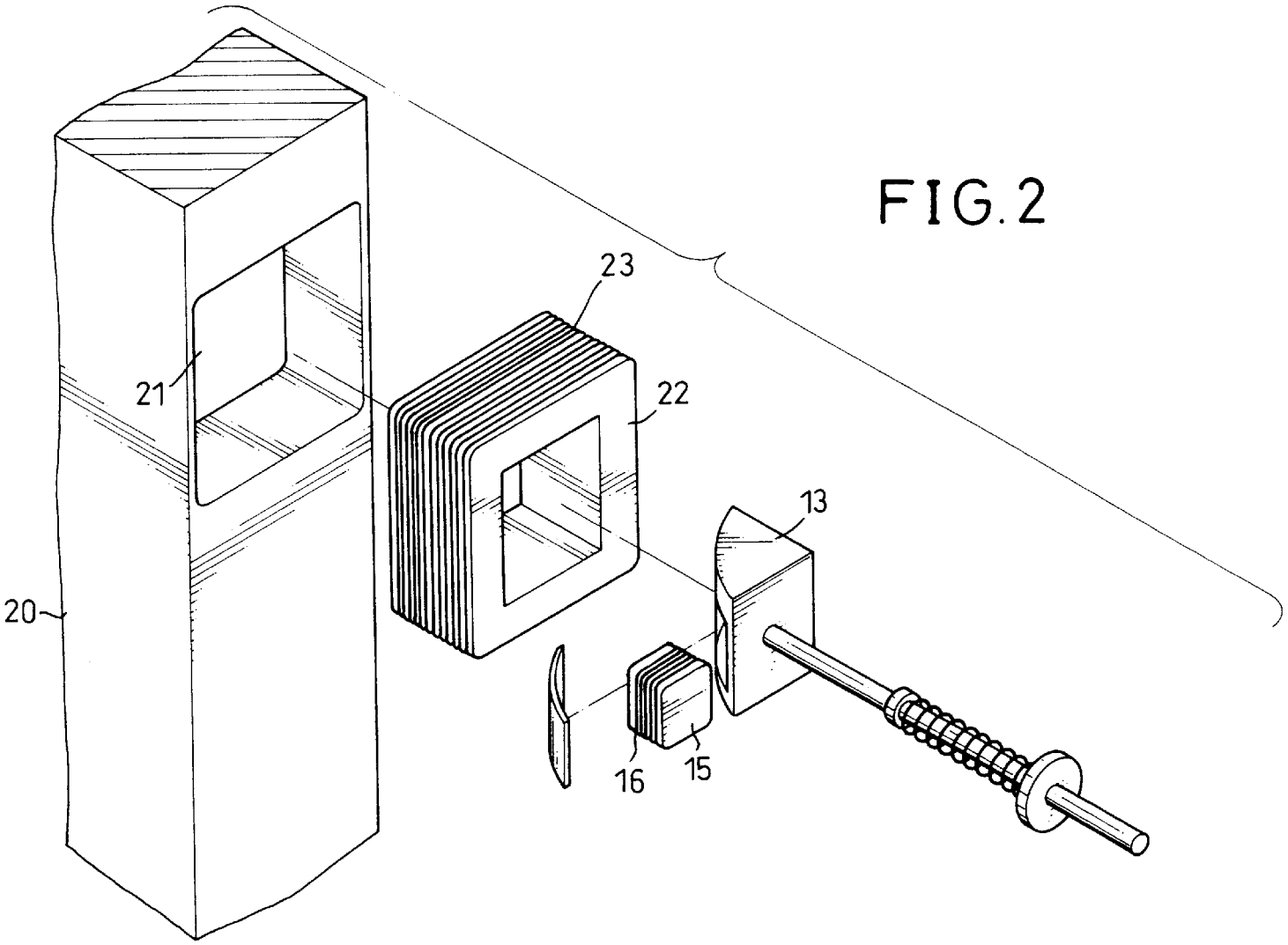
FIG. 2 is an exploded perspective partial view of the powering supplying device in accordance with the invention.

Referring to FIGS. 1 and 2, a door lock has a body (10) and a dead bolt (30) movably installed in the body (10). The dead bolt (30) can be unlocked by a motor (29). A latch bolt is provided beneath a cam (not numbered) pushing the dead bolt (30) and movably extends through a retaining plate (11). The latch bolt (12) is controlled by a knob (not shown nor numbered) to transversally move. A hollow tongue (13), of which a cross section is substantially triangular, is provided at a front end of the latch bolt (12) adjacent to the doorframe. A resilient member (14) is provided on the latch bolt (12) and between the disk (11) and a flange (not numbered). An iron core (15) with a first coil (16) is received in the tongue (13). The first coil (16) is electrically connected with a circuit board (27) by a first electrical wire (26), and the circuit board (27) is respectively connected with a storage battery (28) and the motor (29).

A strike plate (20) is provided on the door frame and has a first hole (202) and a second hole (21) respectively in alignment with the dead bolt (30) and the latch bolt (12). An inductor (22) with a second coil (23) is provided in the second hole (21). The second coil (23) is electrically connected with a voltage transformer (25) by a second electrical wire (24). The voltage transformer (25) is supplied with AC.

The electric current transformed by the transformer (25) is conducted to the second coil (23), and by mutual inductance, the first coil (16) generates an induced current to charge up the storage battery (28). Thus, the storage battery (28) can supply power for the motor (29) to rotate the cam to lock or unlock the dead bolt (30).

Figure 3:
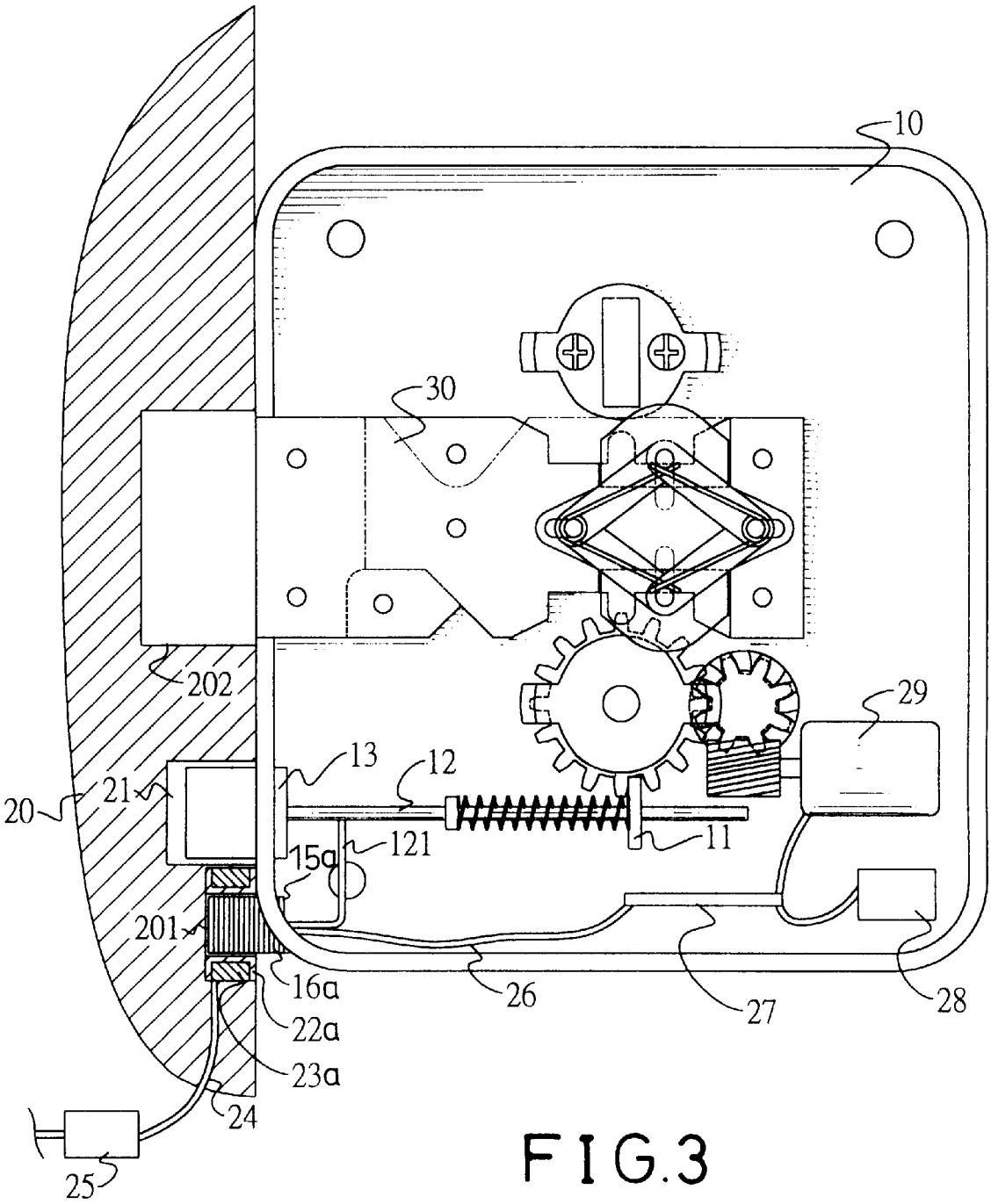
FIG. 3 is a schematic view of a second embodiment of the power supplying device.

Referring to FIG. 3, in a second embodiment of the invention, the latch bolt (12) has a lower L-shaped linkage (121) formed thereon and extending downwards. An iron core **(15*a*) with a first coil (16*a*) is formed at a distal end of the L-shaped linkage (121). The first coil (16*a*) is electrically connected with the circuit board (27) by the first electrical wire (26). A third hole (201) is defined in the strike plate (20) and in alignment with the iron core (15*a*) for receiving the iron core (15*a*). An inductor, (22*a*) with a second coil (23*a*) is provided in the third hole (201). The second coil (23*a*) is electrically connected with the voltage transformer (25) by the second electrical wire (24). The voltage transformer (25)** is supplied with AC.

Figure 4:
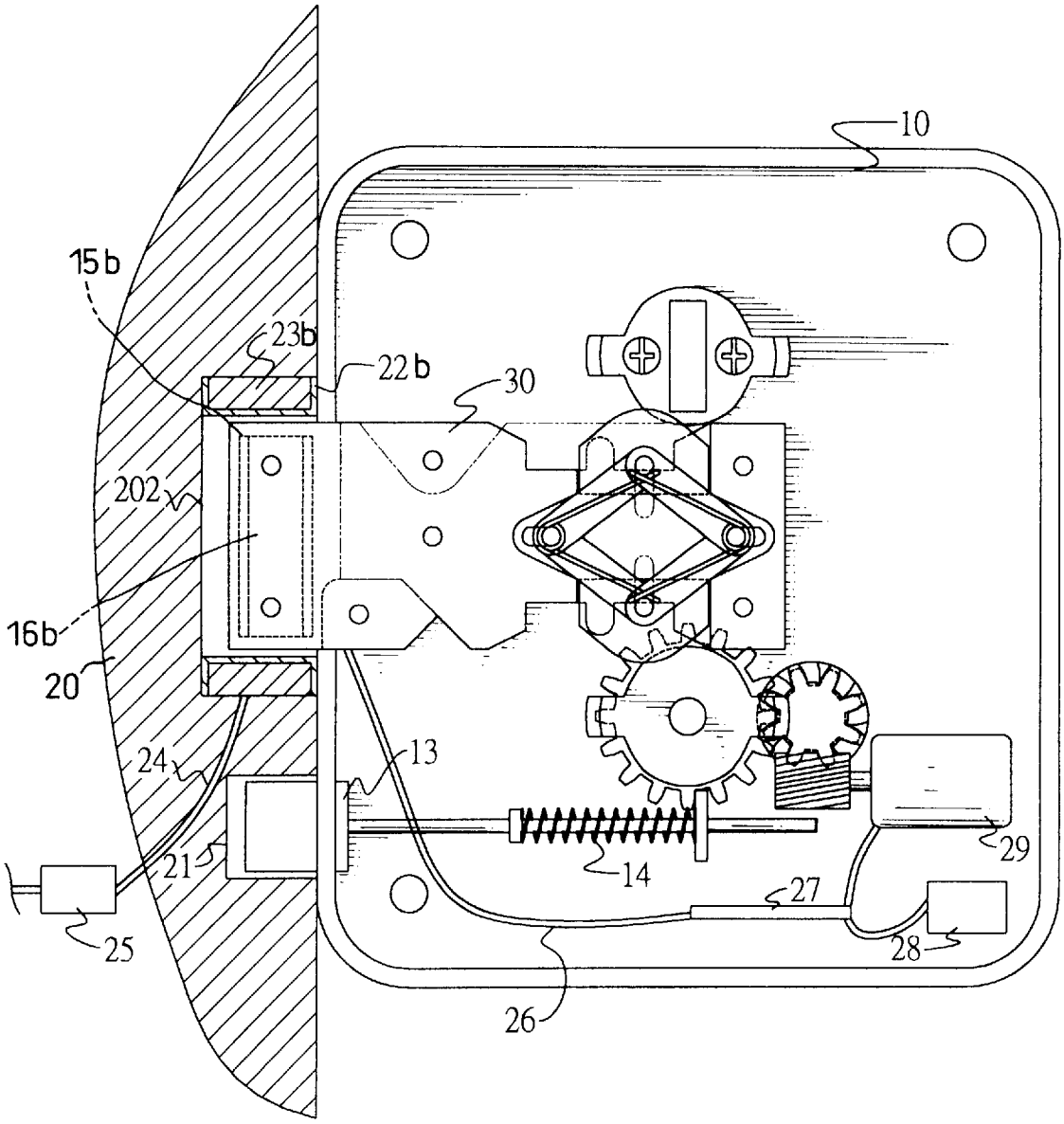
FIG. 4 is a schematic view of a third embodiment of the power supplying device.

Referring to FIG. 4, in a third embodiment of the invention, an iron core **(15*b*) with a first coil (16*b*) is received in the dead bolt (30). An inductor (22*b*) with a second coil (23*b*) is provided in the first hole (202)**.

Figure 5:
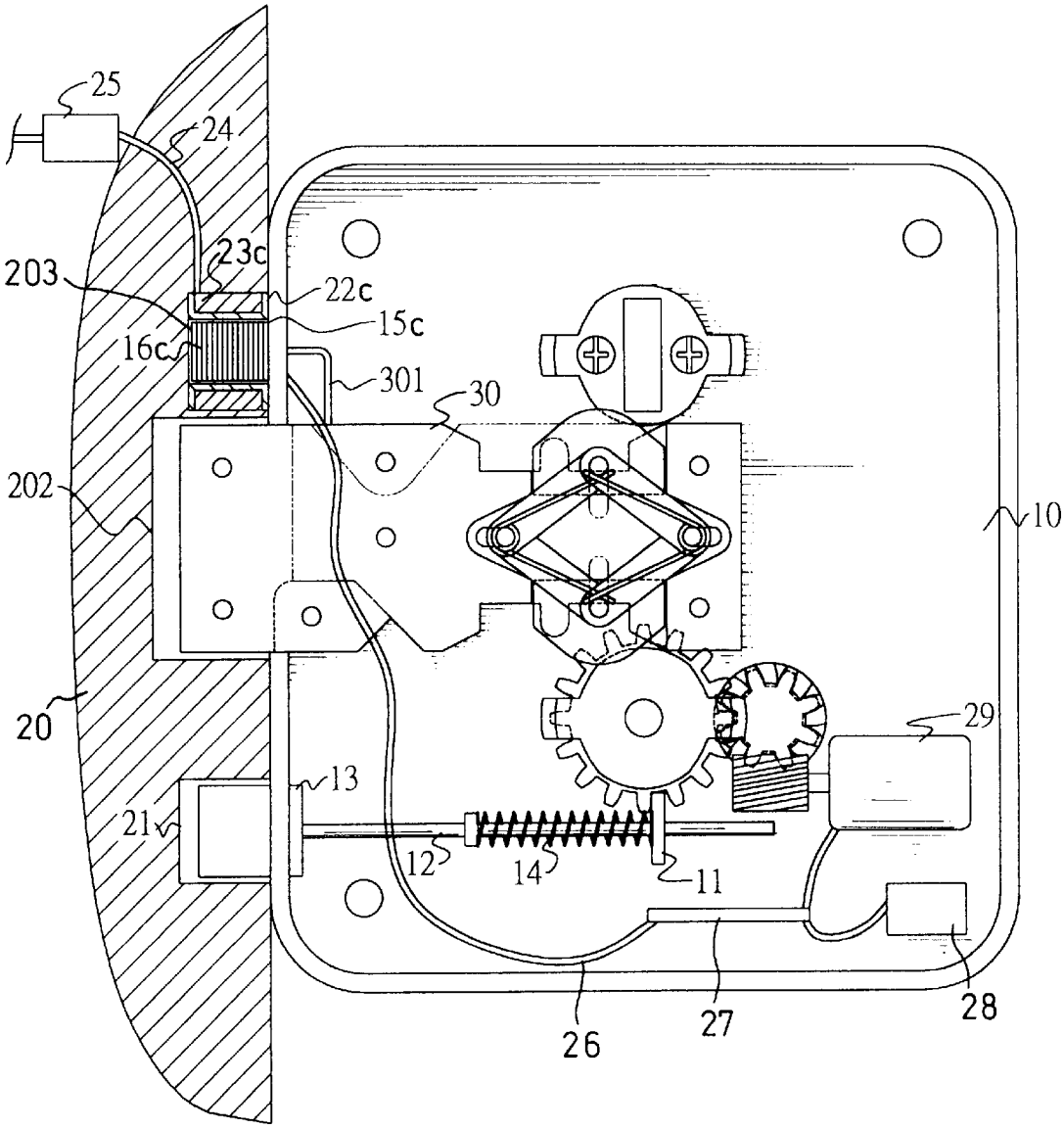
FIG. 5 is a schematic view of a fourth embodiment of the power supplying device.

Referring to FIG. 5, in a fourth embodiment of the invention, an upper L-shaped linkage (301) extending downwards is formed on a top of the dead bolt (30). An iron core **(15*c*) with a first coil (16*c*) is formed at a distal end of the upper L-shaped linkage (301). A fourth hole (203) is defined above the first hole (202) for receiving the iron core (15*c*). An inductor (22*c*) with a second coil (23*c*) is provided in the fourth hole (203)**.

From the above description, it is noted that the invention has the following advantages:

1. Because the storage battery (28) is charged up by the mutual inductance between the iron core (15) and the inductor (22), and the wires (24, 27) are completely hidden in the body (10) and the doorframe, there is no exposed wire which can be pinched or damaged by the door.
2. The hidden wires (24, 27) can not be damaged and give the door a good appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power supplying device for a door lock, the power supplying device comprising:

a body (10);

a dead bolt (30) installed on the body (10) and driven by a motor (29), wherein the motor (29) is electrically connected with a storage battery (28);

a latch bolt (12) installed on the body (10) and driven by a knob, the latch bolt (12) movably extending through a disk (11) fixed on the body (10), and having a tongue (13) formed at a distal end thereof, and a resilient member (14) provided between the disk (11) and a flange on the latch bolt;

an iron core (15) movably installed on the body (10) and having a first coil (16) electrically connected with a circuit board (27) by a first wire (26), wherein the circuit board (27) is electrically connected with the storage battery (28); and a strike plate (20) mounted on a doorframe, the strike plate (20) having a first hole (202) for receiving the dead bolt (30) and a second hole (21) for receiving the latch bolt (12), and having an inductor (22) with a second coil (23) for receiving the iron core (15) therein, wherein the second coil (23) is electrically connected with a transformer (25) by a second wire (24), and the transformer (25) is supplied with AC, whereby, an induced current is generated in the first coil (16) by the mutual inductance between the iron core (15) and the inductor (22) to charge up the storage battery (28) for supplying power for the motor (29).

2. The power supplying device for a door lock as claimed in claim 1, wherein the tongue (13) is hollow and the iron core (15) with the first coil is received in the tongue (13); and the inductor (22) with the second coil (23) is installed in the second hole (21).

3. The power supplying device for a door lock as claimed in claim 1, wherein the iron core (15) with the first coil (16) is received in the dead bolt (30); and the inductor (22) with the second coil (23) is installed in the first hole (202).

4. The power supplying device for a door lock as claimed in claim 1, wherein the latch bolt (12) has a lower linkage (121) formed thereon, and the iron core (15) with the first coil (16) is formed at a distal end of the lower linkage (121) and parallel to the tongue (13); and the strike plate (20) has a third hole (201) defined therein for receiving the iron core (15), and the inductor (22) with the second coil (23) is installed in the third hole (201).

5. The power supplying device for a door lock as claimed in claim 4, wherein the lower linkage (121) is L-shaped.

6. The power supplying device for a door lock as claimed in claim 1, wherein the dead bolt (30) has an upper linkage (301) formed thereon, and the iron core (15) with the first coil (16) is formed at a distal end of the upper linkage (301) and parallel to the dead bolt (30); and the strike plate (20) has another hole (203) defined therein for receiving the iron core (15), and the inductor (22) with the second coil (23) is installed in said another hole (203).

7. The power supplying device for a door lock as claimed in claim 6, wherein the upper linkage (301) is L-shaped.

8. A power supplying device for a door lock, the power supplying device comprising:

a body (10);

a dead bolt (30) installed on the body (10) and driven by a motor (29), wherein the motor (29) is electrically connected with a storage battery (28);

an iron core (15) movably installed on the body (10) and having a first coil (16) electrically connected with a circuit board (27) by a first wire (26), wherein the circuit board (27) is electrically connected with the storage battery (28); and a strike plate (20) mounted on a doorframe, the strike plate (20) having a first hole (202) for receiving the dead bolt (30), an inductor (22) with a second coil (23) for receiving the iron core (15) therein, wherein the second coil (23) is electrically connected with a transformer (25) by a second wire (24), and the transformer (25) is supplied with AC, whereby, an induced current is generated in the first coil (16) by the mutual inductance between the iron core (15) and the inductor (22) to charge up the storage battery (28) for supplying power for the motor (29).

9. The power supplying device for a door lock as claimed in claim 8, wherein the inductor (22) with the second coil (23) is installed in a second hole (21).

10. The power supplying device for a door lock as claimed in claim 8, wherein the iron core (15) with the first coil (16) is received in the dead bolt (30); and the inductor (22) with the second coil (23) is installed in the first hole (202).

11. The power supplying device for a door lock as claimed in claim 8, wherein the strike plate (20) has a third hole (201) defined therein for receiving the iron core (15), and the inductor (22) with the second coil (23) is installed in the third hole (201).

12. The power supplying device for a door lock as claimed in claim 8, wherein the dead bolt (30) has an upper linkage (301) formed thereon, and the iron core (15) with the first coil (16) is formed at a distal end of the upper linkage (301) and parallel to the dead bolt (30); and the strike plate (20) has another hole (203) defined therein for receiving the iron core (15), and the inductor (22) with the second coil (23) is installed in said another hole (203).

13. The power supplying device for a door lock as claimed in claim 12, wherein the upper linkage (301) is L-shaped.

* * * * *